United States Patent [19]

Hirabayashi

[11] Patent Number: 4,912,920

[45] Date of Patent: Apr. 3, 1990

[54] ULTRASONIC BURNER SYSTEM FOR REGENERATING A FILTER

[75] Inventor: Hideo Hirabayashi, Tokyo, Japan

[73] Assignee: Toa Nenryo Kogyo Kabushiki Kaisha, Tokyo, Japan

[21] Appl. No.: 305,136

[22] Filed: Feb. 2, 1989

[51] Int. Cl.[4] ..... F01N 3/10

[52] U.S. Cl. ..... 60/303; 60/286; 431/1

[58] Field of Search ..... 431/1, 8, 9, 173, 350; 60/286, 303; 239/102

[56] References Cited

U.S. PATENT DOCUMENTS

| | | | |
|---|---|---|---|
| 3,904,347 | 9/1975 | Rokudo et al. | 431/1 |
| 4,345,431 | 8/1982 | Suzuki et al. | 60/286 |
| 4,541,239 | 9/1985 | Tokura et al. | 60/286 |
| 4,557,108 | 12/1985 | Torimoto | 60/286 |
| 4,608,013 | 8/1986 | Gaysert et al. | 431/1 |
| 4,622,811 | 11/1986 | Distel et al. | 60/303 |
| 4,651,524 | 3/1987 | Brighton | 60/303 X |

*Primary Examiner*—Randall L. Green
*Attorney, Agent, or Firm*—Armstrong, Nikaido, Marmelstein, Kubovcik & Murray

[57] ABSTRACT

An ultrasonic burner system for regenerating a filter comprises an ultrasonic atomizer for atomizing fuel oil into fine droplets and a combustion chamber that is adapted to pass a exhaust gas created therein by the combustion of the fine droplets toward the filter to regenerate the filter by burning previously unburnt matter trapped thereby, wherein the fine droplets are burned in such a manner that the exhaust gas is at a higher temperature in the wall region than in the axially central part of the combustion chamber. Consequently, the combustion chamber can be made compact, and since the temperature of the combustion gas flowing in the combustion chamber is made higher in the wall region than in the axially central part of the combustion chamber, the temperature distribution in the filter can be made uniform.

1 Claim, 4 Drawing Sheets

FIG. 2
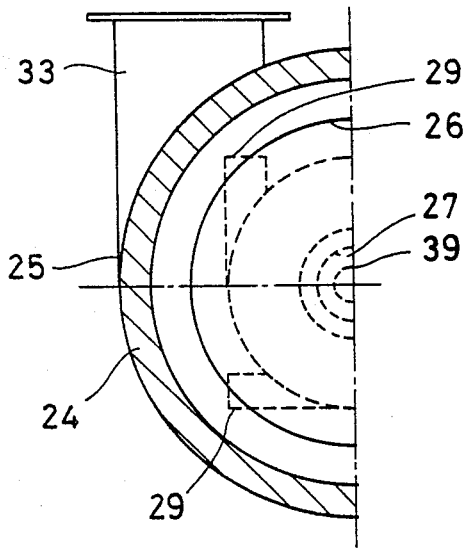
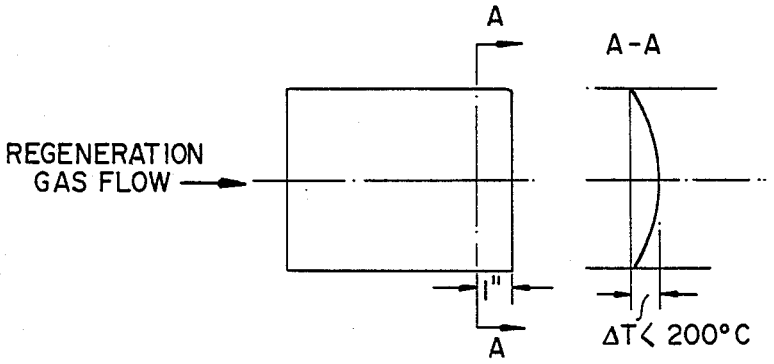
FIG. 3(a) FIG. 3(b)

FIG. 5
PRIOR ART
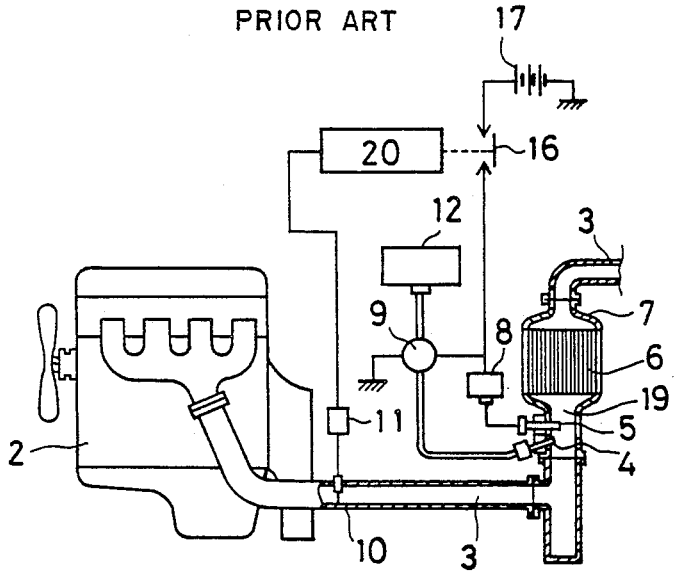
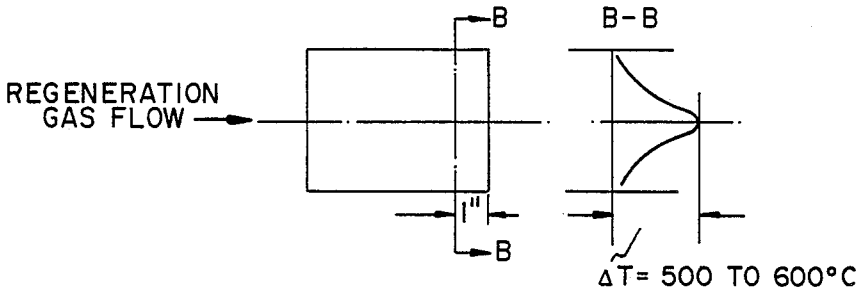
FIG. 6(a) FIG. 6(b)

ULTRASONIC BURNER SYSTEM FOR REGENERATING A FILTER

BACKGROUND OF THE INVENTION

The present invention relates to a filter for removing particulates such as carbonaceous materials carried by the exhaust gases of a diesel engine, and more particularly to an ultrasonic burner system for burning particulates trapped by a filter.

In recent years, regulations on emission of exhaust gases from vehicles driven by internal combustion engines, particularly diesel engines, are becoming more and more stringent. With respect to particulates carried by the exhaust gases, there is a trend in some states of the U.S. toward quantitatively restricting their level to approximately ⅓ of the present level. However, the conventional means of modifying the combustion system for an engine cannot adequately cope with such stringent control.

Most efforts to remove particulates from the diesel engine exhaust gases have been directed to trapping them by a filter, usually made of a ceramic material, which is periodically regenerated by burning the particulates, the heat required for combustion being supplied either from an electric heater or combustion of a diesel fuel. Some filters may be coated with a catalyst film to lower the combustion temperature; in such a case the filter may be regenerated by the exhaust gases, without using a special heating system. In the aforementioned catalytic filter system, there are problems in that the production costs of the filter are high, and that the catalyst tends to be deactivated by sulfur compounds contained in the exhaust gases. In addition, the exhaust gases alone as the heat source may not always function effectively depending on the engine conditions. The system using an electric heater has a drawback that the power consumption by the electric heater is high, so that this system is unsuitable for automobiles that use batteries as a power source. Accordingly, to overcome such problems, the system that burns part of diesel fuel to generate heat necessary for the regeneration has been recently attracting attention in the industry.

FIG. 5 illustrates a system disclosed by the Japanese Patent Laid-Open No. 43114/1985, which incorporates a system of burning particulates in accordance with the aforementioned system (3). This system is arranged as follows: A housing 7 incorporating a filter 6 made of a ceramic is connected midway in the exhaust pipe 3 of an engine 2 so as to remove particulate matter carried by the exhaust gases. When the amount of the particulate matter trapped by the filter 6 increases, the fluid resistance of the filter 6 also increases. As a result, pressure differential across the filter rises, which is detected by an exhaust gas pressure sensor 10, and a signal obtained by a pressure/electricity converter 11 is input to a controller 20. Subsequently, a switch 16 is closed on the basis of a determination made by the controller 20 to connect a fuel pump 9 and an ignition device 8 to a power source battery 17. Then, fuel is injected from a fuel tank 12 through a burner 4 provided upstream of the filter 6 by means of a fuel pump 9, and, at the same time, a spark is generated at an ignition plug 5 by the ignition device 8 so as to ignite the burner 4. Thus, the high-temperature combustion gas is supplied to the filter 6 to burn the particulate matter trapped by the filter 6, thereby regenerating the filter 6.

In the above-described conventional system, however, since the high-pressure fuel is injected from the burner 4, the flame reaches the filter 6 without being sufficiently mixed with the air flow, and, as shown by the line B in FIGS. 6(a) and 6(b), as for the radial temperature distribution of the filter trap 6, the temperature of the central portion is abnormally higher than that of the outer peripheral portion. This may produce a sufficient thermal shock that can damage the filter.

To overcome this problem, if the length of a combustion line 19 is set to 10 to 15 times greater than the diameter of the filter, the flame can be mixed well with the carrier gas, and the radial temperature distribution of the filter becomes uniform. However, if the diameter of the filter is set to 10 cm, the length of the combustion line 19 becomes 1 m to 1.5 m, so that there is the problem that such a particulate combustion system cannot be mounted on a vehicle having a limited space.

In the case of the invention disclosed in, for instance, Japanese Utility Model Publication No. 29135/1988 in order to solve such problems, an attempt is made to allow the primary air introduced in a tangential direction and the secondary air introduced rearwardly thereof to swirl in mutually opposite directions, but this arrangement disadvantageously requires a complicated system.

SUMMARY OF THE INVENTION

Accordingly, an object of the present invention is to provide a compact ultrasonic burner system for regenerating a filter which is capable of making a combustion chamber compact by the use of a burner using an ultrasonic atomizer and of making uniform the radial temperature distribution of the filter as the temperature of the combustion gas flowing through the combustion chamber is made higher at the peripheral portion than at the axially central portion of the combustion chamber so as to prevent damage of the filter and reduce the length of a combustion line, thereby overcoming the above-described drawbacks of the conventional art.

To this end, according to the present invention, there is provided an ultrasonic burner system for regenerating a filter provided in the exhaust line of a diesel engine, comprising: an ultrasonic atomizer for atomizing fuel oil into fine droplets, and a combustion chamber that is provided in front of the filter and that is adapted to pass hot combustion gases created therein by the combustion of the fine droplets toward the filter to regenerate the filter by burning particulate matter trapped thereby, wherein the fine droplets are burned in the combustion chamber in such a manner that the hot combustion gases are at a higher temperature in the wall region than in the axially central part of the combustion chamber.

In accordance with the present invention, it is possible to shorten the flames in the combustion chamber and thereby to make the overall filter system compact, while preventing large, unburned fuel droplets from trickling down from the burner and, at the same time, soot from adhering to, and accumulating on, the combustion chamber walls. It is also possible to reduce a radial temperature differential in the filter, and thereby to mitigate thermal stresses which would lead eventually to damages of the filter. It is further possible to provide a wider operable load range.

BRIEF DESCRIPTION OF THE DRAWINGS

FIG. 2 is a side elevational view of FIG. 1 as seen from right-hand side thereof;

FIGS. 3(a) and 3(b) are diagrams illustrating the temperature distribution of a filter in a case where the present invention is applied;

FIG. 5 is a diagram illustrating a conventional filter burning system; and

FIGS. 6(a) and 6(b) are diagrams illustrating the temperature distribution of a conventional filter.

DESCRIPTION OF THE PREFERRED EMBODIMENTS

Figure 1:
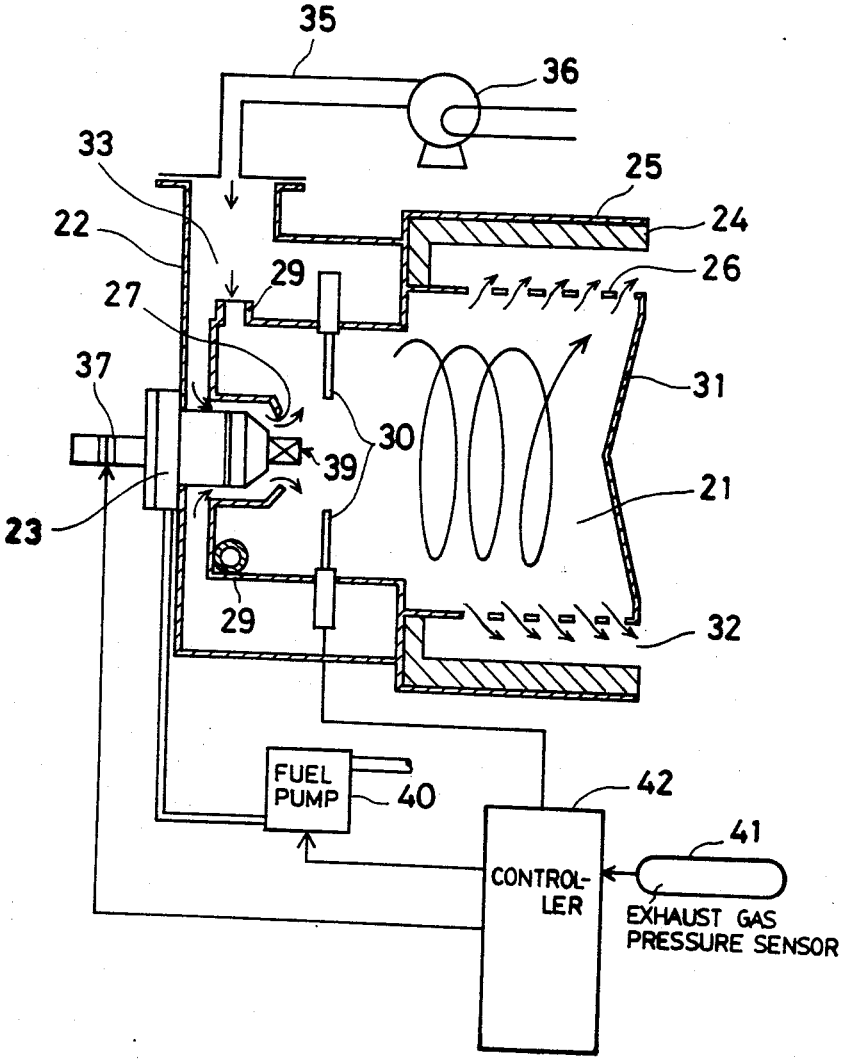
FIG. 1 is a cross-sectional view illustrating an embodiment of an ultrasonic burner system for regenerating a filter in accordance with the present invention.

In FIG. 1, the ultrasonic burner system for regenerating a filter in accordance with the present invention comprises a combustion chamber 21, an air supply duct 22, and an ultrasonic atomizer 23.

The combustion chamber 21 comprises an outer barrel 25 lined with a refractory material 24 and an inner barrel 26 having a multiplicity of holes through which the combustion gases flow out of the combustion chamber. An air/fuel mixture guiding port 27 is provided in one side of the combustion chamber 21. In addition, as shown in detail in FIG. 2, four air swirling nozzles 29 are provided in the outer peripheral portion of the combustion chamber to guide combustion air into the combustion chamber in a tangential direction, and an ignition plug 30 is installed in a face-to-face relationship with the air/fuel mixture guiding port 27. Meanwhile, a baffle 31 is disposed on the other side of the combustion chamber 21, and an annular combustion gas discharge port 32 is formed between the inner barrel 26 and the refractory material 24. The high-temperature combustion gas discharged therefrom is introduced into a filter (not shown) disposed downstream of this burner system.

An air passage 33 is formed between the air supply duct 22 and the combustion chamber 21, and since a blower 36 is connected to the air passage 33 via an air pipe 35, the atmospheric air supplied from the blower 36 is introduced into the air/fuel mixture guiding port 27 and the air swirling nozzles 29. In addition, an ultrasonic atomizer 23 which is inserted and disposed in the mixture guiding port 27 is installed in the air supply duct 22. This ultrasonic atomizer 23 is arranged such that a piezoelectric transducer horn 39 is vibrated by an ultrasonic oscillator 37 so as to atomize the fuel sent from a fuel pump 40 into fine droplets. The fuel supplied to the piezoelectric transducer horn 39 is atomized by the ultrasonic vibrations after flowing in a thin film over the horn surface. Subsequently, pressure of the exhaust gases is detected by an exhaust pressure sensor 41, and an operation signal is transmitted to the ultrasonic oscillator 37, the fuel pump 40, and the ignition plug 30 on the basis of a determination made by a controller 42.

As for the aforementioned piezoelectric transducer horn 39, it is possible to use any of those that are disclosed in, for instance, the official gazettes of Japanese Patent Laid-Open Nos. 222552/1985, 138558/1986, 138559/1986, 259780/1986, 259781/1986, and 140667/1987, or specifications of applications of such as Japanese Utility Model Application No. 97790/1986, Japanese Patent Application Nos. 131950/1986, 180163/1986, 180164/1986, 182756/1986, and 23867/1987, Japanese Utility Model Application No. 60731/1987, and Japanese Patent Application No. 90746/1987.

A description will now be given of the operation of the ultrasonic burner system of the present invention having the above-described arrangement. Part of the combustion air introduced from the blower 36 into the air passage 33 inside the air supply duct 22 via the air pipe 35 is sent to the air swirling nozzles 29, the remainder being sent to the air/fuel mixture guiding port 27. Subsequently, the air flowing into the air/fuel mixture guiding port 27 flows into the combustion chamber 21 while it is being mixed with the atomized fuel produced by the piezoelectric transducer horn 39 of the ultrasonic atomizer 23 to form an air-fuel mixture having an appropriate mixing ratio. On the other hand, the air flowing tangentially from the air swirling nozzles 29 flows into the combustion chamber 21 in the form of a strong swirling current, and the air-fuel mixture flowing into the combustion chamber through the mixture guiding port 27 is carried in the direction of the ignition plug 30 by means of the kinetic energy of this swirling current so as to burn the fuel.

As a result of a combustion experiment conducted by the present inventors by using a conventional pressure injection-type burner system, it was found that a strong swirling current which is produced at the time when the combustion air introduced into the air passage 33 passes through the air swirling nozzles 29 moves inside the combustion chamber 21 toward the discharge port 32, and a flame having a length of several hundred millimeters or thereabouts is formed in the axially central portion of the combustion chamber by this swirling current. On the other hand, in the case of the above-described ultrasonic burner system for regenerating a filter in accordance with the present invention, since the initial velocity of atomized fuel is slow, atomized fuel can be easily carried by the strong swirling current from the air swirling nozzles 29, and the fuel and the air are mixed well, so that the long flame having a length of several hundred millimeters or thereabouts, which is created in the conventional case, is not generated, and a short flame is formed. Moreover, since the combustion gas which flows in a swirling manner in the space of the combustion chamber defined by the inner barrel 26 and the baffle 31 is dispersed through the multiplicity of holes and flows out of the inner barrel 26, the long flame as in the conventional case is not produced. In addition, since the refractory material 24 is heated to a high temperature by the combustion gas dispersed and flowing out of the inner barrel 26, complete combustion in the combustion chamber 21 can be ensured, and the stabilization of combustion and high-load combustion can be realized.

As a result, in a case where the ultrasonic burner system for regenerating a filter in accordance with the present invention is mounted in the exhaust line of an internal combustion engine shown in FIG. 5, the radial temperature distribution in the filter 6, i.e., the temperature difference between the central portion and the outer peripheral portion thereof, is very small, as shown by the line A in FIGS. 3(a) and 3(b) with the result that the problem of breakage of the filter 6 due to the thermal stresses created therein can be greatly mitigated. In this case, even if the length of the combustion passage 19 is made very short, the radial temperature differential in the filter 6 becomes very small, so that the overall system can be made compact.

Figure 4:
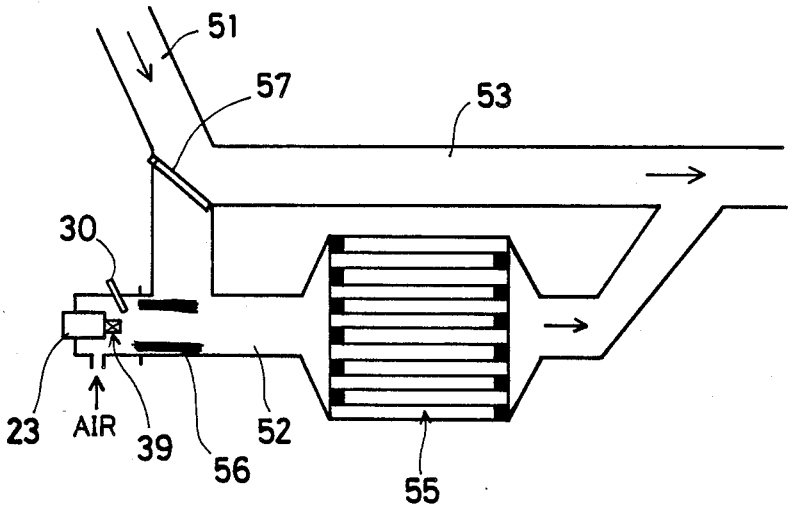
FIG. 4 is a diagram illustrating another embodiment of the present invention.

Referring now to FIG. 4, a description will be given to another embodiment of the present invention.

An exhaust pipe 51 of a diesel engine is branched into a main exhaust pipe 52 and a bypass pipe 53. A honeycomb-type filter 55 is provided in the main exhaust pipe 52, and the ultrasonic burner shown in FIG. 1 is provided in such a manner as to oppose the filter 55. In this embodiment, the piezoelectric transducer horn is so shaped as to direct the atomized droplets towards the combustion chamber walls, so that an annular flame 56 is formed in the vicinity of walls. As a result, temperature of the combustion gases is higher at the peripheral portion of the combustion chamber than at the axially central portion thereof, making the radial temperature distribution flatter in the filter than the distribution which would be created in the filter of the conventional system. In this embodiment, the exhaust gases are directed to the bypass duct by means of the damper 57, while the filter 55 is being regenerated.

As described above, although a method for regenerating a filter by using the air has been disclosed, regeneration may be effected by making use of part of the exhaust gas. In this case, with reference to FIG. 4, the flow rate of the exhaust gas in the main exhaust pipe 52 or the bypass pipe 53 is controlled. Furthermore, in FIG. 4, although the ultrasonic atomizer 23 is disposed upstream of the filter 55, the ultrasonic atomizer 23 may be disposed downstream of the filter 55.

What is claimed is:

1. An ultrasonic burner system comprising:

a filter trap disposed in an exhaust line of a diesel engine; and an ultrasonic burner for passing a combustion gas through said filter trap to burn unburnt substances on said filter trap, said ultrasonic burner includes a combustion chamber, an ultrasonic atomizer disposed on one side of said combustion chamber and capable of atomizing a fuel into fine droplets, an air/fuel mixture guiding port formed in a periphery of said ultrasonic atomizer, and at least one air swirling nozzle provided tangentially to an outer periphery of said combustion chamber;

wherein a higher combustion temperature is developed in a peripheral region of said combustion chamber than in a core region of said combustion chamber.

* * * * *